United States Patent [19]

Schmerein, Jr.

[11] 4,406,941

[45] Sep. 27, 1983

[54] ELECTRIC IGNITING DEVICE FOR CHARCOAL

[76] Inventor: John D. Schmerein, Jr., 815 River La., Neenah, Wis. 54956

[21] Appl. No.: 361,746

[22] Filed: Mar. 25, 1982

[51] Int. Cl.[3] ..... F23Q 7/04

[52] U.S. Cl. ..... 219/261; 219/267; 219/270; 219/521; 361/266

[58] Field of Search ..... 219/260, 261, 267, 270, 219/386, 521, 552, 523; 361/266; 110/350

[56] References Cited

U.S. PATENT DOCUMENTS

| | | | |
|---|---|---|---|
| 2,917,615 | 12/1959 | Raines | 219/267 |
| 2,917,675 | 12/1959 | Norton, Jr. | 219/267 |
| 2,920,243 | 1/1960 | Tarin | 219/270 |
| 2,938,988 | 5/1960 | McCutcheon et al. | 219/270 |
| 3,339,505 | 9/1967 | Bean | 219/261 X |
| 3,413,935 | 12/1968 | Behrns | 219/261 X |
| 3,529,557 | 5/1969 | Treanor | 219/260 X |
| 3,628,474 | 12/1971 | Rehwaldt | 219/260 X |
| 4,260,872 | 4/1981 | Brodmann et al. | 219/270 |

*Primary Examiner*—Volodymyr Y. Mayewsky

[57] ABSTRACT

An electric charcoal igniting device consisting of an upright open-ended sleeve of fire-resistant sheet metal in combination with an electric heating element. The heat loop of the electric element is disposed in the interior of the sleeve and the insulated handle of the element is secured to the exterior wall of the sleeve. In use the device is placed directly onto the pan, or coal-holding grate, of a charcoal grill, the sleeve is filled with the desired amount of charcoal briquets or the like, and the electric element is plugged in to ignite the briquets. When the desired degree of ignition is obtained, the device is lifted by the handle leaving the ignited coals in place.

4 Claims, 3 Drawing Figures

ELECTRIC IGNITING DEVICE FOR CHARCOAL

BACKGROUND OF THE INVENTION

1. Field of the Invention

This invention relates to an improved electric igniting device for charcoal briquets or similar fuel. The device facilitates the initiation of combustion in a loose pile of charcoal pieces with improved efficiency and reduced handling of the charcoal.

2. Description of the Prior Art

In the last twenty years or so, outdoor barbecuing has rapidly increased in popularity, and much attention has been given to developing better grills and more convenient ways to initiate combustion of the charcoal fuel.

One such device which has found some success in the marketplace as a charcoal starter is described in U.S. Pat. No. 3,453,975 to Gunter dated July 8, 1969. Gunter uses an open-ended tubular sheet metal housing in the form of a truncated cone, with a perforated grate disposed horizontally halfway up the cone. A lifting handle is affixed to one side of the housing. Charcoal is placed on top of the grate and paper or other readily ignitible material is placed thereunder and ignited to get the charcoal glowing. After the coals are started, the device is lifted by the handle and turned over to dump the glowing coals through the top opening and into the charcoal grill's coal pan or grate.

While this device fulfills its desired purpose, it often requires several feedings of the readily ignitible material to get the fire going; and lifting the device to put new fuel in place is inconvenient and awkward. Also, when the hot coals are dumped, the glowing or still burning remnants of the starting fuel are not easy to dispose of and may be a fire hazard if carelessly handled.

U.S. Pat. No. 3,529,557 to Treanor, dated Sept. 22, 1970, attacks the problem in another way. Treanor employs a mesh basket for containing the charcoal and has integrally attached to the basket an electric heating element. This arrangement is much more convenient, but it still requires lifting the filled container and dumping the hot coals through the top opening of the basket into the coal pan of the charcoal grill. Extreme care must be exercised to avoid accidents during this operation.

U.S. Pat. No. 3,339,505 to Bean, dated Sept. 5, 1967, is somewhat similar to Nelson in operation, but in addition to an electric element also suggests the use of gas and liquid fuels as the ignition means. The suggested device is very sturdily constructed and accordingly could be difficult to handle and dump during use.

U.S. Pat. No. 3,628,474 to Rehwaldt, dated Dec. 21, 1971, suggests a charcoal starting device which consists of a basket having upstanding wire mesh sidewalls and a slot through which a separate electric starting device may be inserted. The employment of a separate basket and a separate starting element requires handling each unit individually necessitating great dexterity and skill. In addition, care must be exercised in setting aside the hot starting element after the coals are ignited.

While each of these prior art devices have contributed to the art, the present invention is believed to provided a number of improvements thereover including a simpler construction and more convenience in handling, as well as some safety features.

SUMMARY OF THE INVENTION

This invention is directed to an improved electric igniting device for charcoal which consists of an upright open-ended sleeve of fire-resistant sheet metal forming an enclosure wall for containing a loose pile of charcoal briquets or similar fuel. An electric heating element is integrally associated with the sleeve. The heat loop of the element, which is of conventional high resistance material, is disposed interiorly of the enclosing sleeve wall. The heat loop extends from an insulating handle to which it is attached, and the handle itself is firmly secured to the exterior of the sleeve wall in an area spaced from the bottom end of the sleeve. The handle thus is adapted to lift and maneuver the sleeve as desired. An electric cord not shown is provided for supplying current to the high resistance coil, and extends through the handle in a known manner. A plug-in unit may be provided at the end of the handle or the cord may be continuous.

In use, the bottom of the sleeve is placed directly on the coal-holding pan, or grate, or a barbeque grill, and filled with the desired amount of charcoal. The electric heating element is plugged in to heat the coil and initiate combustion of the loosely stacked charcoal pieces. When the coals are ignited and glowing to the desired degree, the entire sleeve with the integral heating element is lifted, allowing the charcoal pieces to fall through the bottom opening and remain on the grate or pan. Since the heat loop of the heating element is spaced from the bottom edge of the sleeve, the device may be safely set aside for cooling without danger of setting fire to something else. The possibility of small children or pets being inadvertently burned by the still warm element is also considerably lessened because of the protective sleeve.

BRIEF DESCRIPTION OF THE DRAWINGS

In the drawings in which like numbers define like parts.

DETAILED DESCRIPTION OF THE DRAWINGS AND PREFERRED EMBODIMENTS OF THE INVENTION

Figure 1:
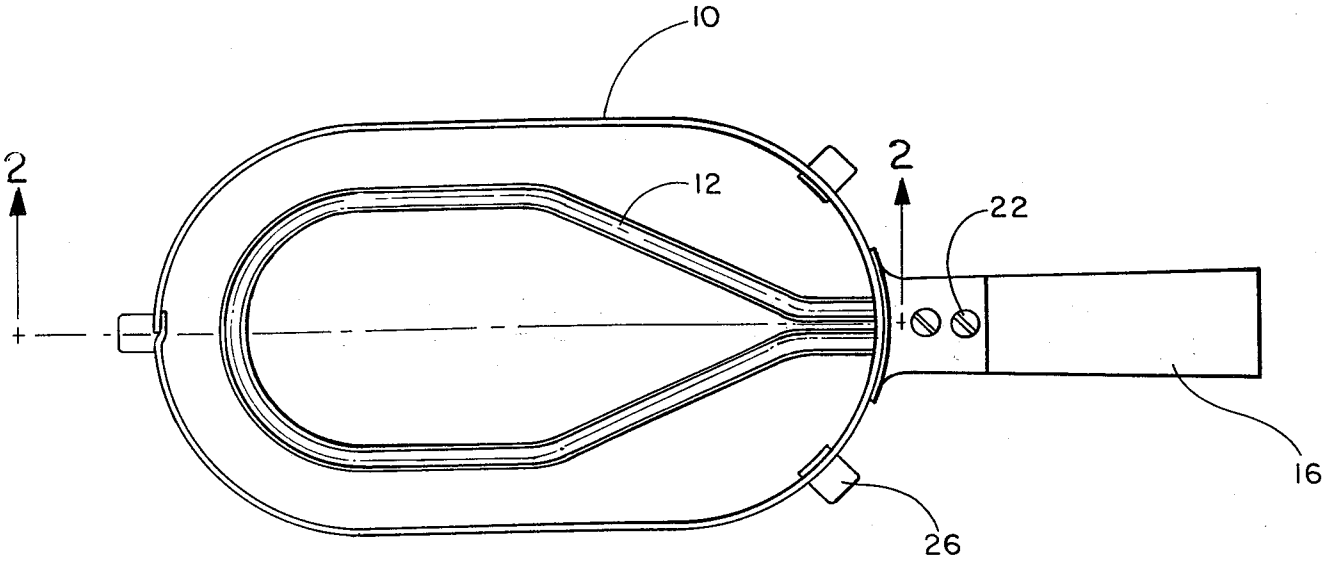
FIG. 1 is a top plan view of a preferred embodiment of the charcoal igniting device of this invention.
Figure 3:
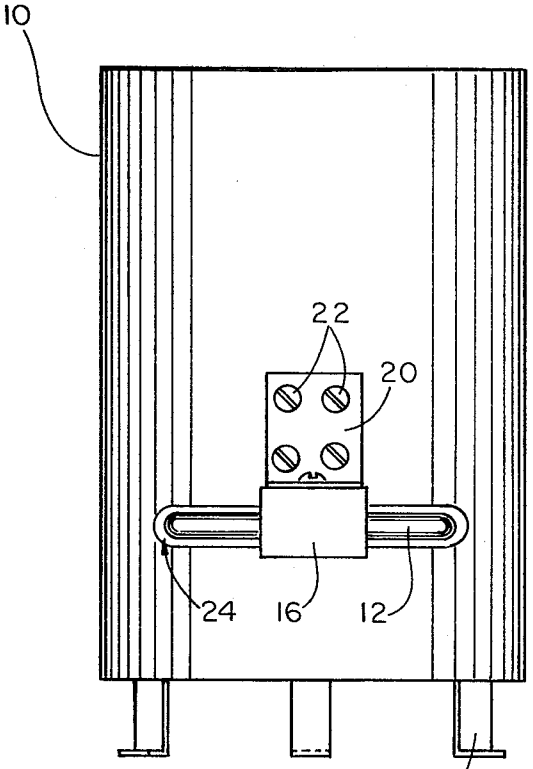
FIG. 3 is an end view of FIG. 1 as seen from the handle end.
Figure 2:
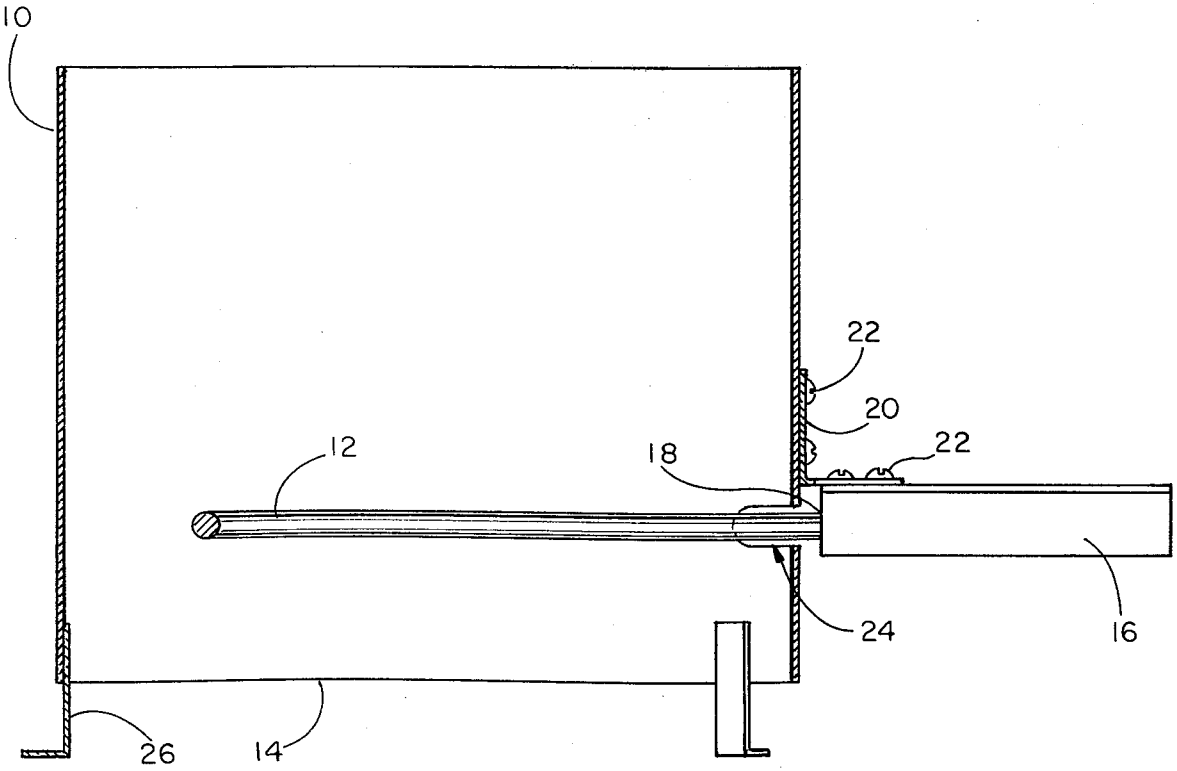
FIG. 2 is a vertical section of FIG. 1 taken along line 2—2 of FIG. 1.

As shown in the drawings, a preferred embodiment of the improved electric igniting device of this invention is comprised of an upright open-ended sleeve 10 of fire-resistant sheet metal which forms a containing wall for a loose pile of charcoal briquets or similar fuel when disposed therein. An electric heating element for igniting the charcoal and consisting of a heat loop 12 and an insulating handle 16 is attached to the exterior of a wall portion of sleeve 10.

Heat loop 12 is disposed inside of sleeve 10 near the lower end of the sleeve and spaced a suitable distance from the edge 14 of the sleeve. A suitable distance is at least the depth of a normal sized charcoal briquet.

Heat loop 12 extends from, and is connected to, insulating handle 16 at 18, and handle 16, at this connecting point, is firmly secured to the exterior wall of sleeve 10 by suitable metal screws, or rivets, 22 and by metal flange 20.

For convenience in assembly, a slot 24 may be provided in sleeve 10 through which the heat loop of a unitary heating element may be inserted. However, an alternate structure without the slot may be utilized. In such event only a small aperture is bored in the sleeve wall. The heating element is dismantled, to separate the coil from the handle, and the prongs of the coil are pushed through the small aperture from the inside of the sleeve and then reconnected to the handle.

While not shown in the drawings, it is understood that the electric heating element is provided with a conventional electric wire to supply current to the resistance coil. The wire may run directly through the handle or have a plug-in unit at the end of the handle for extra convenience.

A suitable sheet metal for the sleeve has been found to be 24 gauge (American) galvanized sheet metal. While this is utilitarian, a more delux model could employ stainless steel sheets or other expensive metals such as copper or brass.

A conventional resistance type electric heater unit is suitable for carrying out the ignition task.

The sleeve 10 may also be provided with L-shaped legs 26, but these are not essential to the structure. Either three or four legs may be used.

The sleeve, as shown in the drawings, is elliptical in cross section. This shape has been found to be the most practical from a structural and convenience standpoint. However, other cross-sectional shapes may be used without detracting from the essential function of the invention. For example; oval, round, square or rectangular shapes might be used.

In a working model of the invention, the elliptical section shown in the drawings had a long dimension of $9\frac{3}{8}''$ and a short dimension of $5\frac{3}{8}''$. These were largely chosen to accommodate a prefabricated heating element in which the coil was spaced 111/16" from the sleeve to permit charcoal briquets to slide through. Spacing about equal to the diameter of a briquet is suitable. These dimensions are not critical but are given to illustrate a practical embodiment. Dimensions may be varied as desired to meet the needs of the manufacturer and for convenience in handleable size by the user.

In use, the device of this invention is placed directly on the coal pan, or grate when provided, of a conventional barbeque device. The desired amount of charcoal is poured through the top opening of the sleeve. The electric heating element is connected to a source of electricity to heat the coil. When the charcoal is ignited and glowing to the desired degree, the device is grasped by the handle and simply lifted upward. The bottom layer of lighted charcoal remains in place and the remaining pieces drop through the coil onto the bottom layer. Not other maneuvering of the device or dumping of hot coals is necessary.

It should be noted that the open-ended sleeve shown in the drawings and described herein does not have any opening in the walls other than the optional slot 24 used for assembly purposes. One might assume that side openings of some type would be necessary to aid combustion. Such openings have not been found necessary. Apparently, the closed wall structure confines the heat sufficiently to provide quick starting, while sufficient oxygen is provided through the open bottom to permit suitable convection and movement of air. The closed wall also confines dust when charcoal is poured in, and provides for safer handling of the heated coil when removed from the grill.

What is claimed is:

1. An electrical charcoal igniting device consisting of the combination of an upright open-ended sleeve of fire-resistant sheet metal with an electric starting element, said sleeve comprising a closed wall structure having a top open end and a bottom open end, said bottom open end of said sleeve being provided with supporting leg means, said electric starting element comprising a high resistance heat loop connected to an insulating handle, said heat loop being disposed inside of said sleeve near to, but spaced from, the bottom end of said sleeve, said sleeve having an aperture in said closed wall near said bottom end, through which aperture a portion of said heat loop disposed adjacent to said handle extends, and said handle, adjacent to where said handle is connected to said heat loop, being firmly secured to the interior of said sleeve, whereby said handle is adapted to lift said sleeve and said heat loop as a unit.

2. The igniting device of claim 1 wherein said sleeve is of elliptical cross-section.

3. The igniting device of claim 1, wherein said loop is spaced from the interior of said sleeve a distance approximately equal to the diameter of a charcoal briquet.

4. The igniting device of claim 1, wherein said aperture comprises an elongate horizontal slot through which said heat loop may be inserted for assembly.

* * * * *

UNITED STATES PATENT AND TRADEMARK OFFICE

CERTIFICATE OF CORRECTION

PATENT NO. : 4,406,941

DATED : September 27, 1983

INVENTOR(S) : John D. Schmerein, Jr.

It is certified that error appears in the above-identified patent and that said Letters Patent are hereby corrected as shown below:

Col. 3, line 18, "delux" should read --deluxe--.

Col. 3, line 37, "111/16"" should read --1-11/16"--.

Col. 4, line 39, "interior" should read --exterior--.

Signed and Sealed this

Tenth Day of January 1984

[SEAL]

*Attest:*

*Attesting Officer*

GERALD J. MOSSINGHOFF

*Commissioner of Patents and Trademarks*